US005078302A

United States Patent [19]

Hellenberg

[11] Patent Number: 5,078,302

[45] Date of Patent: Jan. 7, 1992

[54] PAINT DISPENSING APPARATUS

[75] Inventor: Leen Hellenberg, JA Katwijk, Netherlands

[73] Assignee: Fluid Management Limited Partnership, Wheeling, Ill.

[21] Appl. No.: 485,251

[22] Filed: Feb. 26, 1990

Related U.S. Application Data

[63] Continuation-in-part of Ser. No. 380,974, Jul. 17, 1989, Pat. No. 4,967,938.

[51] Int. Cl.[5] ..... B67D 5/60

[52] U.S. Cl. ..... 222/144; 141/104; 222/144.5; 222/135; 222/517; 222/544

[58] Field of Search ..... 222/14, 16, 144, 144.5, 222/129, 135, 517, 554; 141/100, 104, 284

[56] References Cited

U.S. PATENT DOCUMENTS

| | | | |
|---|---|---|---|
| 1,782,980 | 11/1930 | Ude | 222/554 |
| 1,961,173 | 6/1934 | Schutte et al. | 222/517 X |
| 2,094,900 | 10/1937 | Mann | 222/554 X |
| 2,787,402 | 4/1957 | Stiner et al. | 222/144 X |
| 2,848,019 | 8/1958 | Corbin et al. | 222/144 X |
| 3,029,847 | 4/1962 | Baudhuin et al. | 222/144 X |
| 3,374,811 | 3/1968 | Goosman | 222/144 X |
| 3,540,631 | 11/1970 | Schmidt | 222/554 X |
| 3,777,950 | 12/1973 | Kiddon | 222/554 |
| 4,027,785 | 6/1977 | Edstrom et al. | 222/135 |
| 4,394,944 | 7/1983 | Rech | 222/554 X |
| 4,967,938 | 11/1990 | Hellenberg | 222/144 |

*Primary Examiner*—Kevin P. Shaver
*Attorney, Agent, or Firm*—Fitch, Even, Tabin & Flannery

[57] ABSTRACT

Apparatus for sealing the colorant-dispensing nozzles of machines adapted for coloring paint base material. Container assemblies of the machine provide storage of the colorants and may include metering apparatus to discharge preselected amounts of colorant through the nozzle into a quantity of paint base material. Flow control valves on the container assemblies block the discharge of colorant material from the metering apparatus. A sealing valve is attached to each nozzle to block the free end of the nozzle against air intrusion.

29 Claims, 6 Drawing Sheets

292
296
300
274
294
252
260
264
290
291
266
258
256
272
250
262
280
282
268
270
276
254
84
156
164
166
194
176
180
182
174
160
210
76
178
230
130
186
184
200
162
170
144
82
168
206

PAINT DISPENSING APPARATUS

RELATED APPLICATIONS

This application is a continuation-in-part of U.S. patent application Ser. No. 380,974, filed July 17, 1989, now U.S. Pat. No. 4,967,938.

BACKGROUND OF THE INVENTION

1. Field of the Invention

This invention relates to apparatus for dispensing paint colorant and, more particularly, to such apparatus which is suitable for an automated operation.

2. Description of Related Art

To avoid having to separately inventory different color paints, many paint retailers use a common paint base that is manually tinted with a colorant on a per-order basis. It is known to provide a turntable supporting a plurality of containers holding colorant which is stored therein in liquid form. Metering structure is provided to dispense measured amounts of colorant from the containers into the paint base.

A merchandiser of paint materials may find it convenient to limit the major portion of paint inventory to a paint base material, which can be tinted or otherwise colored to produce a wide variety of colored paint materials. Thus, a merchandiser need not estimate beforehand the quantity of a given color paint that should be maintained in stock. While the above-mentioned colorant dispensing apparatus can be relied upon to accurately meter even small amounts of colorants required for a given paint formulation, the colorant materials are frequently discharged through a downwardly extending conduit or nozzle which extends below a shut-off valve. Such nozzles have been observed to become clogged with colorant materials which thereafter harden, upon drying.

SUMMARY OF THE INVENTION

It is an object of the present invention to provide a paint colorant and dispensing machine, including such machines which are suitable for fully automatic operation under the control, for example, of a microcomputer.

These and other objects according to the present invention, which will become apparent from the studying of the appended description and accompanying drawings, are provided in a nozzle sealing apparatus for sealing the free end of a downwardly projecting nozzle of a paint colorant dispenser which discharges paint colorant through the nozzle, comprising:

a body having an internal wall defining an internal passageway through which paint colorant is passed, having an upper portion for receiving the nozzle free end with a close fit engagement thereof, and a lower portion remote from the nozzle free end;

a sealing member in the upper portion for hermetic sealing of the body to the nozzle free end;

a cylinder disposed in the lower internal passageway portion, defining an aperture through which paint colorant is dispensed, movable between open and closed positions to open and close a path of colorant flow through said body, respectively;

means for securing said body to said dispensing apparatus so as to maintain said hermetic sealing between said body and the nozzle free end; and an actuating arm joined to said cylinder for moving said cylinder between said open and said closed positions.

Other aspects according to the present invention are attained in an apparatus for dispensing a metered quantity of colorant from a storage canister into a container comprising:

a) a metering chamber having an inlet and an outlet and means for withdrawing a determined quantity of colorant from said storage canister through said metering chamber inlet, and pump means for discharging the colorant in said metering chamber through said metering chamber outlet;

b) flow control valve means at the outlet of said metering chamber for controlling the discharge of colorant material therefrom;

c) a nozzle having a free end, downwardly extending from the outlet of said metering chamber so as to direct the flow of discharged colorant;

d) a sealing valve means located at the free end of said nozzle movable between a first, open position and a second, closed position so as to permit a flow of discharged colorant and to seal the free end of the nozzle to prevent intrusion of air therein, respectively, including:

1) a body having an internal wall defining an internal passageway through which paint colorant is passed, having an upper portion for receiving the nozzle free end with a close fit engagement thereof, and a lower portion remote from the free end;

2) a sealing member in the upper portion for hermetic sealing of the body to the nozzle free end;

3) a cylinder disposed in the lower internal passageway portion, defining an aperture through which paint colorant is dispensed, movable between open and closed positions to open and close a path of colorant flow through said body, respectively;

4) means for securing said body to said metering means so as to maintain said hermetic sealing between said body and the nozzle free end; and 5) an actuating arm joined to said cylinder for moving said cylinder between said open and said closed positions.

Still other aspects according to the present invention are attained in a machine for coloring a container of paint base material, comprising:

a plurality of storage canisters for holding paint colorant materials;

said canisters including metering means associated with each storage canister for withdrawing a preselected amount of colorant material from the storage canister;

said storage canisters further including flow control valve means associated with each metering means for controlling a discharge of colorant material from said metering means through a discharge opening of a nozzle;

a turntable on which said canisters are mounted for rotation about said circular path of travel;

container operating means disposed adjacent said path for delivering metered amounts of colorant material to said container of paint base material;

said container operating means including meter actuating means for actuating said metering means to withdraw a preselected quantity of colorant material from the associated canister and to discharge said colorant material into the container of paint base material;

said container operating means including flow control valve actuating means having an actuating arm attached thereto for opening and closing the flow control valve to permit selective discharge of said colorant to said container of paint base material;

said container operating means including sealing valve means associated with each metering means, located downstream of said flow control valve means and movable between open and closed positions for permitting colorant flow and for sealing the discharge opening of the nozzle, respectively;

means for coordinating the opening of the flow control and sealing valve means, operable by said flow control valve actuating means; and indexing means for indexing said turntable in response to an indexing signal so as to present a preselected container to said container operating means.

BRIEF DESCRIPTION OF THE DRAWINGS

In the drawings, wherein like elements are referenced alike.

DETAILED DESCRIPTION OF THE PREFERRED EMBODIMENTS

Before proceeding with a detailed description of a sealing valve illustrating aspects according to the present invention, a description of one of the various types of apparatus which can be benefitted by the present invention will be given. As will be seen herein, a sealing valve constructed according to aspects of the present invention can be provided as original equipment or as an aftermarket retrofit or upgrade modification to existing paint colorant dispensing machines. The colorant materials, usually fluid or pulverulant in composition, are flowed through a short conduit or nozzle before dropping in a container of paint base material to be colored. These colorant materials are very accurately measured, and it is important that the nozzle not become clogged, either partially or totally by paint colorant materials which may harden upon contact with the surrounding atmosphere.

Other potential problems are presented when machines of the above type are automated, being operated for long periods of time without attention. Further, it is desirable that automated machinery not be restricted in the movement of its internal parts by the sealing valve, even when the valve is carried for movement within the machine.

Figure 1:
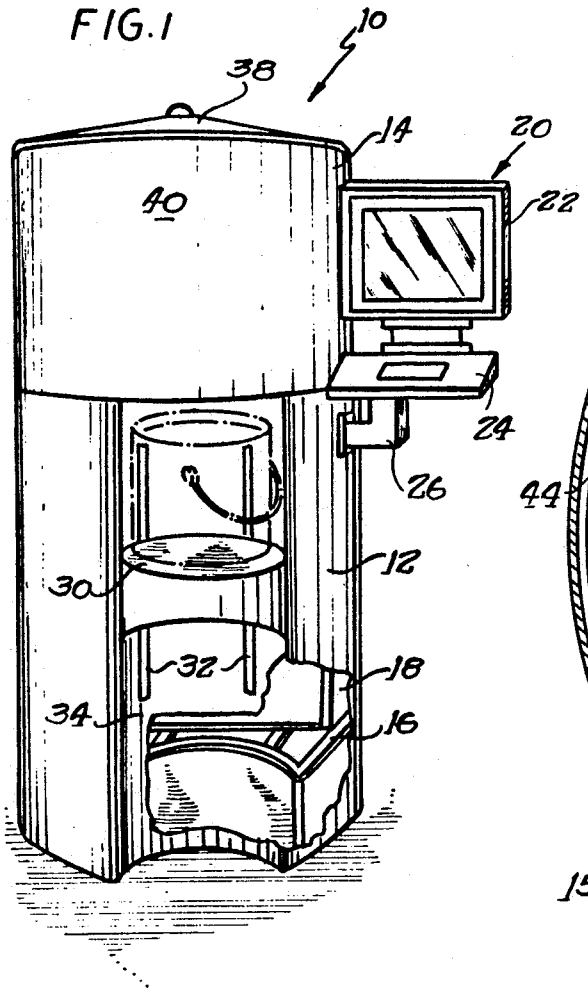
FIG. 1 is a perspective view of a paint colorant and dispensing apparatus of a type adapted for use with the present invention.

Referring now to the drawings and initially to FIG. 1, a fully automated paint colorant and dispensing apparatus is generally indicated at 10. The apparatus 10 includes a lower housing 12 and an upper housing 14 mounted thereon. As can be seen in the lower corner thereof, which is shown partially broken away, housing 12 includes a shelf 16 on which a computer 18 or other digital control apparatus is mounted. The computer 18 is coupled to a terminal generally indicated at 20 which includes a cathode ray tube (CRT) display 22 and a keyboard 24 which are mounted by a support arm 26 to housing 12.

Apparatus 10 further includes an elevator or moveable platform 30 which is slidable in upward and downward directions along tracks 32. The tracks are preferably for ed in a hollow recess 34 of housing 12 which is sized to accommodate a substantial portion of a paint bucket 46 such as that indicated in phantom in FIG. 1. Owing to the recess 34, the upper housing 14 protrudes outwardly, above a central portion of the paint bucket. As will be seen herein, paint colorant is selected, metered, and dispensed within housing 14 so as to drop into the open, upper end of the paint bucket.

Figure 3:
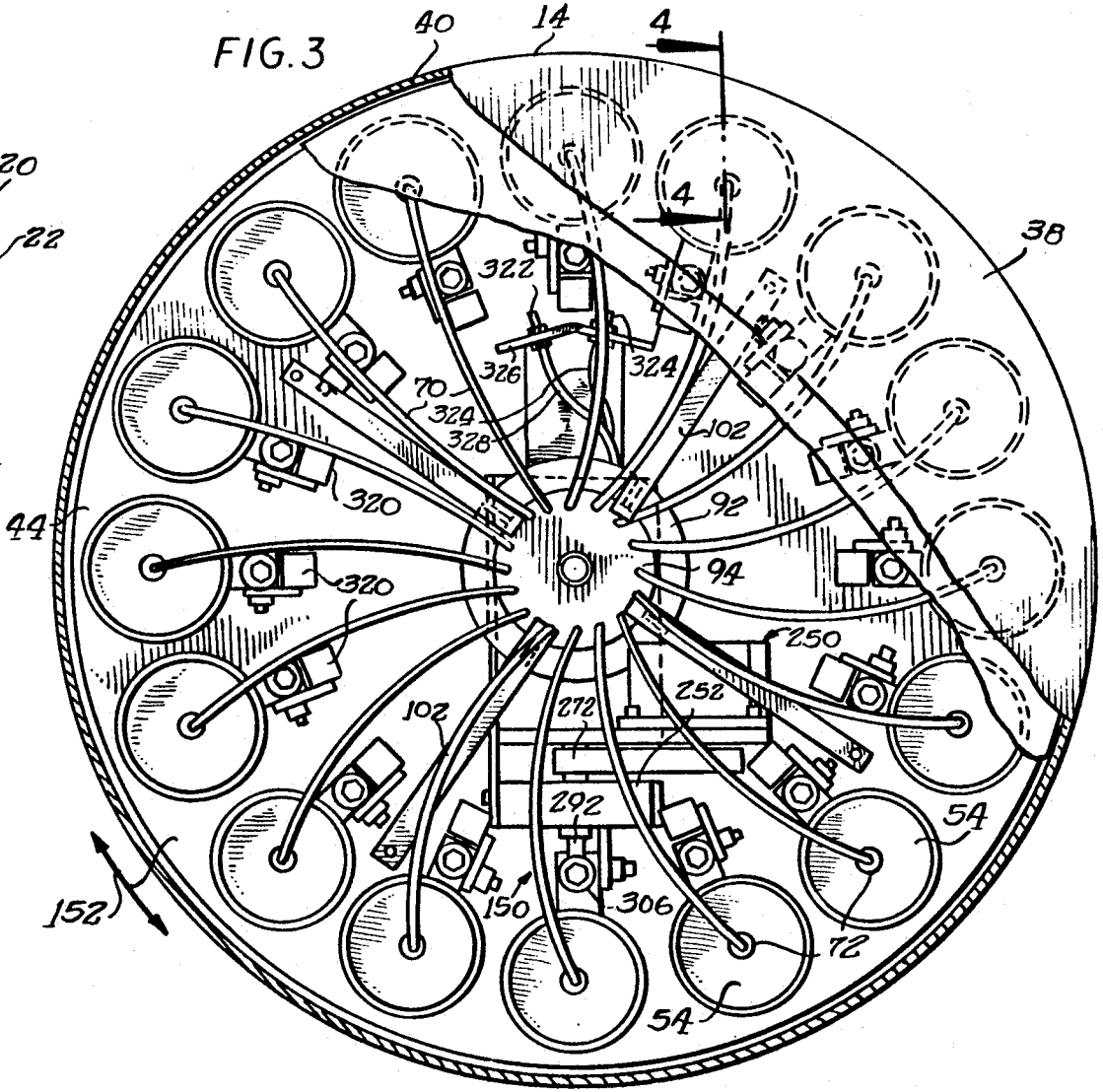
FIG. 3 is a top plan view of the apparatus of FIG. 1, shown with the cover thereof partially broken away.
Figure 2:
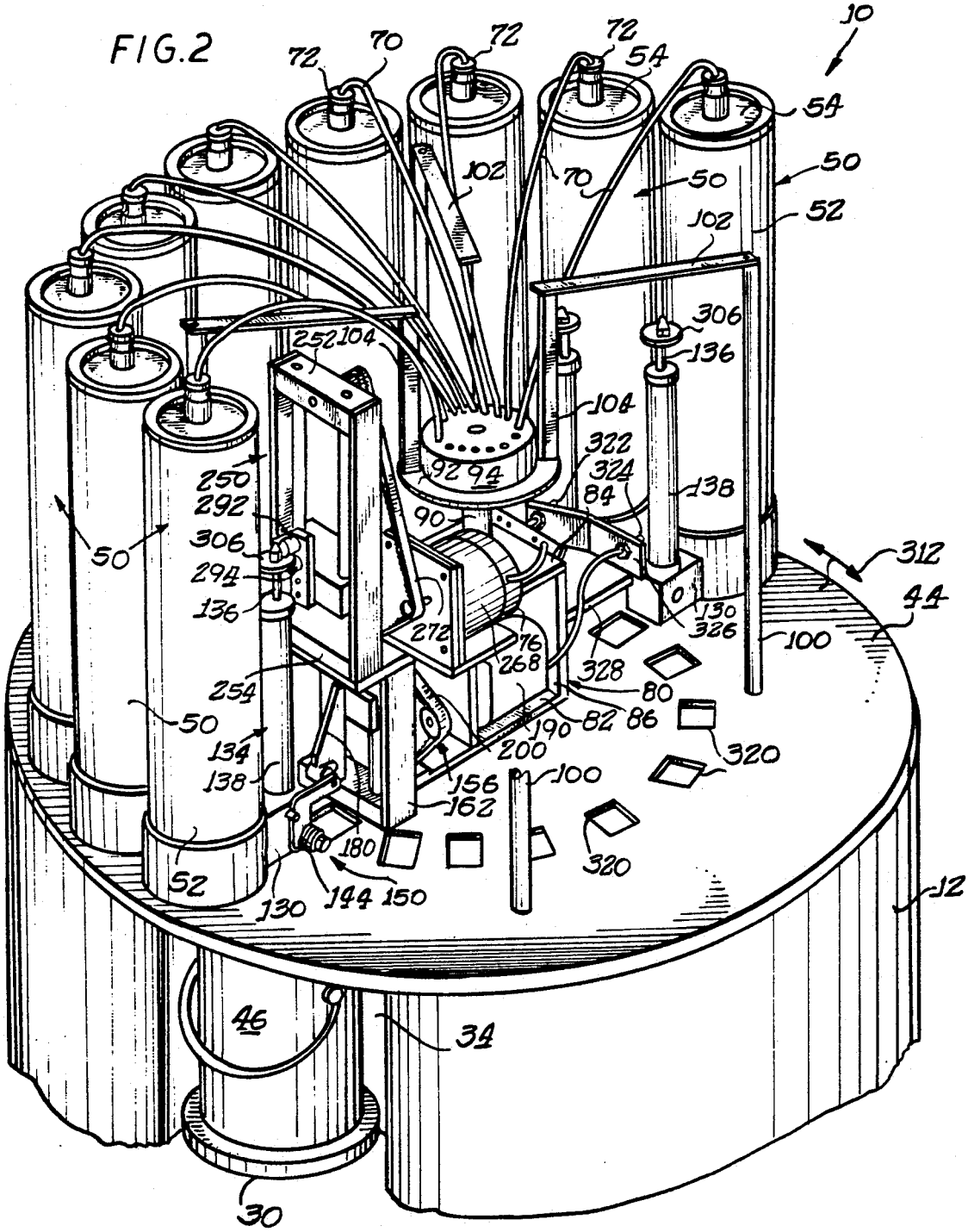
FIG. 2 is a fragmentary perspective view of the apparatus of FIG. 1, shown with the outer cover removed.

With additional reference to FIGS 1 and 3, the upper end of housing 14 is enclosed by a lid or cover 38. Housing 14 further includes an outer, generally cylindrical sidewall 40, preferably made of sheet metal or the like rigid material. FIG. 2 shows the upper portion of the paint colorant and dispensing apparatus 10, with the outer wall 40 and the upper cover 38 removed therefrom to show various internal components of apparatus 10 which are mounted atop a rotating turntable 44. The turntable is rotatably supported at its central portion, as will be seen below with reference to FIG. 5.

As mentioned, above, the housing 14 overlies recess 34, which contain a variety of different sized paint buckets or other containers holding a paint base material. For example, the paint bucket 46 illustrated in FIG. 2 could be dimensioned to store one gallon of paint base material. Given the relative proportions illustrated in the figures, the same apparatus 10 could also readily accommodate conventional paint base containers of one pint, one quart, and five gallon size. As will be seen herein, the sealing according to the present invention can be grounded to a moving dispensing nozzles, and can readily accommodate paint base containers of different sizes.

Referring again to FIG. 2, the paint colorant and dispensing apparatus 10 includes a plurality of colorant container assemblies 50 disposed about turntable 44. According to one aspect of the present invention, the colorant containers are disposed about the outer periphery of turntable 44 so as to be moveable over recess 34, upon rotation of the turntable. In the preferred embodiment, sixteen colorant containers are provided for the apparatus 10, although the apparatus could be readily adapted to accommodate a different number of containers, if desired.

Figure 4:
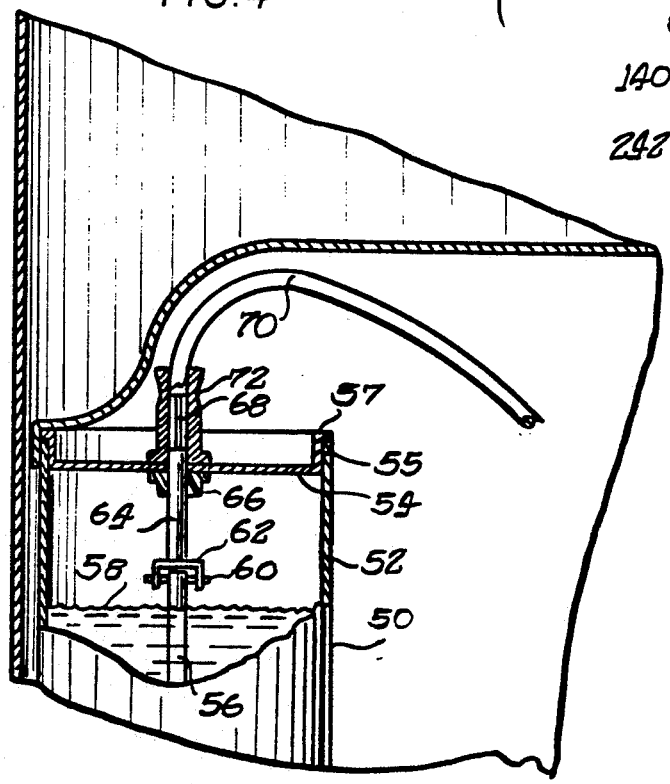
FIG. 4 is a fragmentary cross-sectional view taken along the line 4—4 of FIG. 3.

The paint colorant container assemblies 50 include a generally cylindrical container 52 having an upper, open end enclosed by a lid 54. Disposed within each container is an agitator 56 (see FIG. 4) immersed within the colorant liquid 58. The upper end of agitator 56 includes a lateral pin member 60 received in a U-shaped stirrup 62. The stirrup is slotted at its free end to receive the pin 60 and to engage the pin for rotating the agitator about its longitudinal axis. A stub shaft 64 is journalled for rotation in a sleeve 66 carried on the container cover 54. The stub shaft 256 may have a hollow center for keyed engagement with a shaft 68 of a flexible drive cable 70. The drive cable 70 is terminated at a sleeve 72 which maintains the free end of cable 70 in a generally vertical orientation at its point of connection to the colorant container assembly 50. Various arrangements may be provided for the keyed interconnection between the shaft of flexible cable 70 and the stirrup connector 62. Further details concerning the construction of the keyed interconnection may be found in the aforementioned U.S. Pat. No. 4,813,785 which is herein incorporated by reference.

Referring again to FIG. 2, an agitator drive motor 76 is located at the center of turntable 44. An internal framework structure generally indicated at 80 is also located at the center of turntable 44. The agitator drive motor is preferably disposed within the internal framework structure 80 and, although such cannot be seen in the figures, the output shaft of the agitator drive motor extends in an upright, generally vertical direction. The internal framework structure 80 includes a lower base member 82 which, as will be seen, is fixed in a stationary position, and does not rotate with turntable 44. Structure 80 also includes an upper plate member 84 and a backing member 86. An upright support column 90 extends from the upper plate 84. The support column has a hollow center which receives the output shaft of agitator drive motor 76. A generally circular support plate 92 is mounted atop the support column 90 and supports a gear train mechanism 94 which is coupled to the output shaft of the agitator drive motor 76. The gear train mechanism 94 has a plurality of rotatably driven outputs at its upper end, with each output coupled to rotatably drive a flexible drive cable 70. In the preferred embodiment, gear train mechanism 94 has 16 outputs, each associated with a respective colorant container. Further details concerning the gear train mechanism and the rotatable driving of the agitators in each colorant container may be found in the aforementioned U.S. Pat. No. 4,813,785.

Referring again to FIG. 4, the covers 54 include an upstanding peripheral rim 55 and an outer lip 57 which form a plug fit with the container 52. The plug fit provides a simple and reliable joinder between the covers and cylindrical vessels but, if desired, other, conventional means may be used to releasably join the two. The colorant containers are thus sealed against splashing or flinging of colorant material when the colorant in the containers is agitated. Many colorant materials in use today require constant agitation to prevent "skinning" or partial hardening at the upper surfaces, and to ensure uniform consistency throughout.

Referring again to FIG. 2, a number of framework supports 98 are disposed about turntable 44. The framework supports include upright posts 100 and generally radially extending horizontal members 102 which are supported at their inner free ends by inner upright members 104 extending from the support base 92. The horizontal members 102 of the framework supports protect the various moving mechanisms of apparatus 10, as when the cover 38 is moved to replenish the supply of colorant in container assemblies 50.

Figure 5:
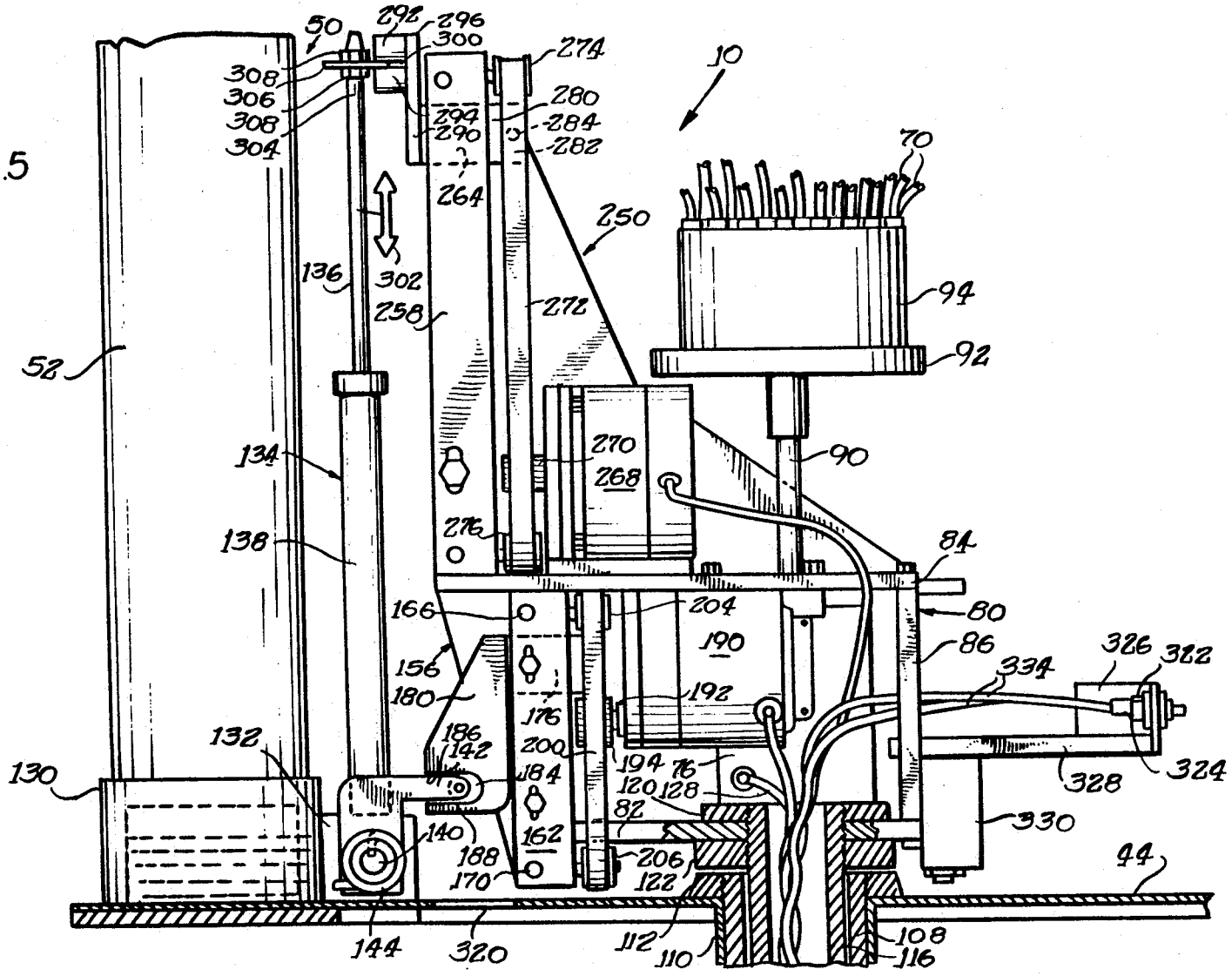
FIG. 5 is a fragmentary side elevational view of the apparatus of the preceding figures, shown partly in cross-section.

As mentioned above, the containers 50 are preferably mounted along an annular path adjacent the outer periphery of turntable 44. Turning now to FIG. 5, turntable 44 is mounted atop a rotating support column 108 which is rotatably driven by conventional mechanism located in lower housing 12. The turntable 44 includes a central, downwardly depending collar 110 telescoped over and affixed to the outer surface of support column 1 08. A ring 112 attached to the upper end of support column 108 clamps turntable 44 in position, and provides a stabilizing thereof against tilting or wobbling. Other, conventional means for attaching turntable 44 to a rotating support shaft may also be used.

A stationary support shaft 116 is concentric with and disposed within the rotating support shaft 108. Upper and lower rings 120, 122 are attached to the upper end of stationary support column 116. The lower base member 82 of the internal framework structure 80 is clamped between the support rings 120, 122 and, additionally, may be attached directly to the stationary support column 116. Alternatively, the lower base member could be attached to the stationary support column with any suitable conventional means such as welding. As can be seen in FIG. 5, the stationary support column 116 has a hollow passageway formed by its internal bore 126, suitable for housing electrical leads such as the electrical lead 128 for energizing the agitation drive motor 76.

Returning again to FIG. 5, a colorant container assembly 50 is illustrated as having the aforementioned container 52 for storing a quantity of liquid coloring material. The container 52 is mounted at its lower end to a flow control valve 130 which includes a valve housing 132 located at the base of container 52. The valve housing 132 includes a passageway communicating with the interior of the container 52 to permit flow of a colorant material to a pump generally indicated at 134. The pump is attached at its lower end to valve housing 132 and defines a metering or pumping chamber in which a piston reciprocates. A pump rod 136 extends above the pumping chamber and is secured to a piston, not shown in the figures, disposed within the pumping chamber.

As the rod is raised, a suction is applied by the piston to withdraw colorant material from container 52, through passageways within base 132. A valve located in the base blocks the outflow from container 50, as well as the discharge of material from the pumping chamber. A shaft 140 is attached to the valve and when rotated, opens and closes the valve. A crank arm 142 is attached to one end of shaft 140 and a spring 144 biases the shaft for rotation in a direction which closes the valve. With continuous rotation of the valve in a given direction, a first portion of the valve opens to permit flow from the storage container 52 to the pumping chamber, while blocking the outlet of the pumping chamber. Upon further rotation, the container 52 is blocked, and a second portion of the valve is opened to permit a discharge of colorant material through a nozzle or other discharge structure into a bucket of paint base material disposed beneath the turntable 44.

According to one aspect of the present invention, a sealing means of the pump discharge cooperates with the pump 134 and the valve within valve housing 132 to provide precisely metered quantities of colorant material, the quantities being directly proportional to the stroke of piston rod 136. Further details concerning the construction and operation of the valve housing 132, the pump 134 and the internal valve are provided in U.S. Pat. No. 4,027,785 which is herein incorporated by reference.

As can now be seen, the dispensing of a metered quantity of colorant material is provided by the sequential operation of the crank arm 142 and the piston rod 136 in the manner described in the aforementioned U.S. Pat. No. 4,027,785. The present invention, in some of its aspects, provides a sealing valve at the pump discharge which is automatically operated along with the automated operation of the crank arm and pump rod, in cooperation with an indexing of table 44, to present a prescribed series of metered quantities of colorant materials at a workstation located above the paint base material. With reference to FIG. 3, a dispensing station generally indicated at 150 is located at a point on the periphery of turntable 44. As will be seen herein, the workstation includes a number of components which are mounted to or otherwise associated with the internal framework structure 80, so as to be located at a fixed stationary position. As the turntable 44 is rotated in opposing directions of arrow 152, a series of colorant containers are presented to workstation 150.

Figure 6:
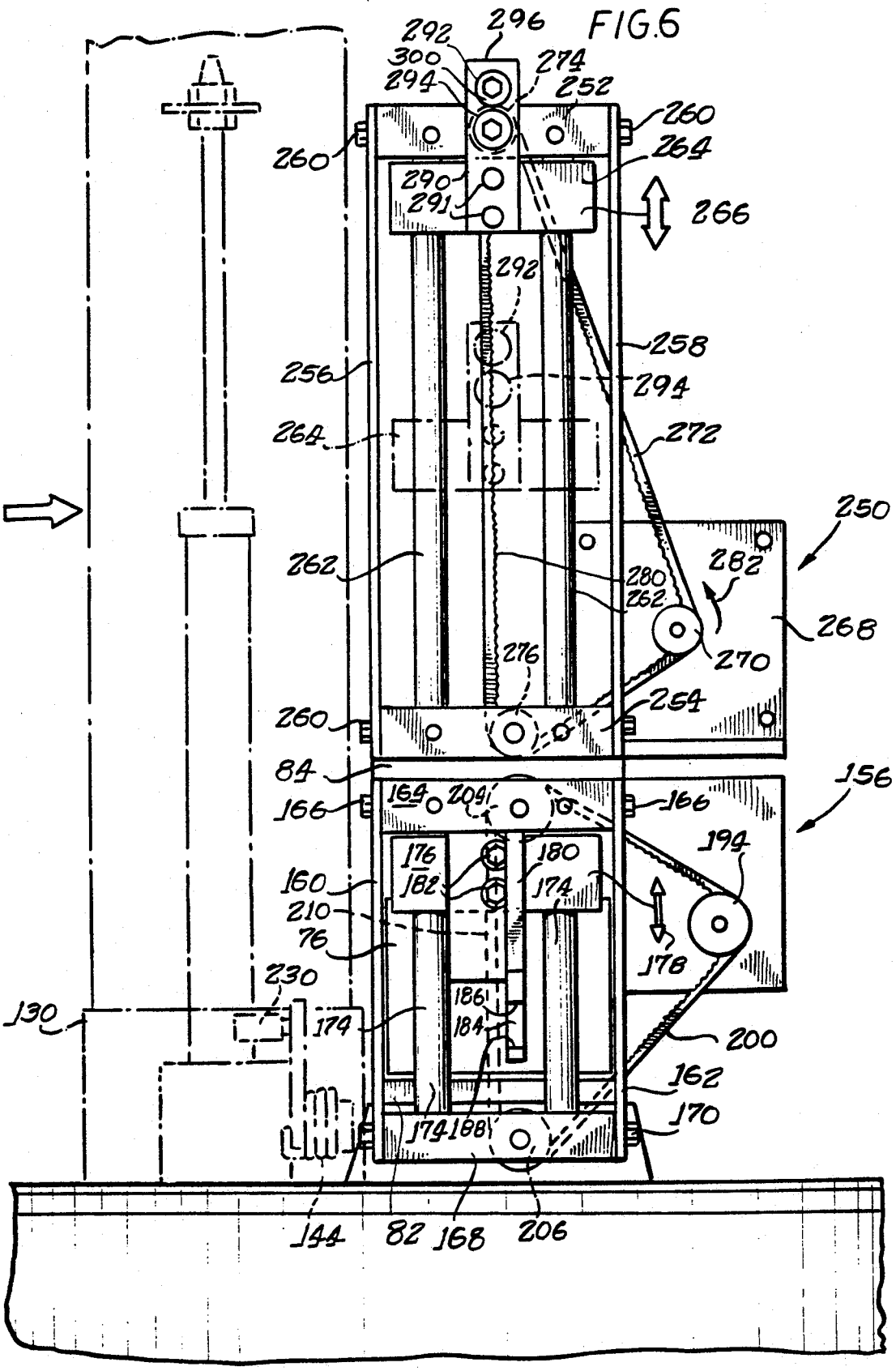
FIG. 6 is a fragmentary front elevational view of the apparatus of the preceding figures.

Referring now to FIG. 2, and especially to FIGS. 5 and 6, a container operating means is located at workstation 150, adjacent the path of travel of colorant containers carried on turntable 44, for delivering metered amounts of colorant materials in the various containers to a container of paint base material, such as the aforementioned bucket 46, located beneath turntable 44. As will be seen, the container operating means includes an arrangement for actuating the metering pump 134, and a mechanism for actuating the valve internal to valve housing 132 as well as the sealing valve according to the present invention, all of which can be readily automated with indexing of turntable 44 carried out under instructions from a digital control unit such as the aforementioned digital computer 18.

Turning now to FIGS. 5 and 6, and referring initially to the lower portions thereof, a valve actuating mechanism is generally indicated at 156. The mechanism is supported by the aforementioned internal framework structure 80 and with reference to FIGS. 5 and 6, includes sidewalls 160, 162, the upper ends of which are attached to the upper plate 84. A header block 164 is attached by bolt fasteners 166 to the upper ends of sidewalls 160, 162. A footer or lower support 168 is secured to the lower ends of sidewalls 160, 162 by bolt fasteners 170. A pair of generally cylindrical guide rails 174 have their opposed ends mounted in the header and footer members 164, 168. A travelling head 166 is reciprocally mounted on guide rails 174 for travel in the vertical directions indicated by arrow 178. A bracket 180 is secured at its upper end to travelling head 176 by bolt fasteners 182. The bracket 180 has an outwardly opening recess 184 formed therein by a pair of opposed upper and lower edges 186, 188.

A valve actuating motor 190 is mounted to the internal framework structure 80 and is oriented so that output shaft 192 thereof extends in an forward, generally horizontal direction. A drive gear 194 is mounted to motor shaft 192 and has an outer toothed surface for engagement with a cog belt 200. With brief reference to FIG. 6, the cog belt 200 follows a generally triangular-shaped path, with one leg of the triangular path extending in a generally vertical direction. Belt 200 is wound about a pair of idler rollers 204, 206, in addition to the drive gear 194. The upper idler roller 204 is mounted to the header block 176 and the lower idler roller 206 is mounted to the footer block 168. The idler rollers 204, 206 are located one above the other so that the portion 210 of belt 200, spanning the distance between the idler rollers 204, 206, extends in a generally vertical direction.

Figure 7:
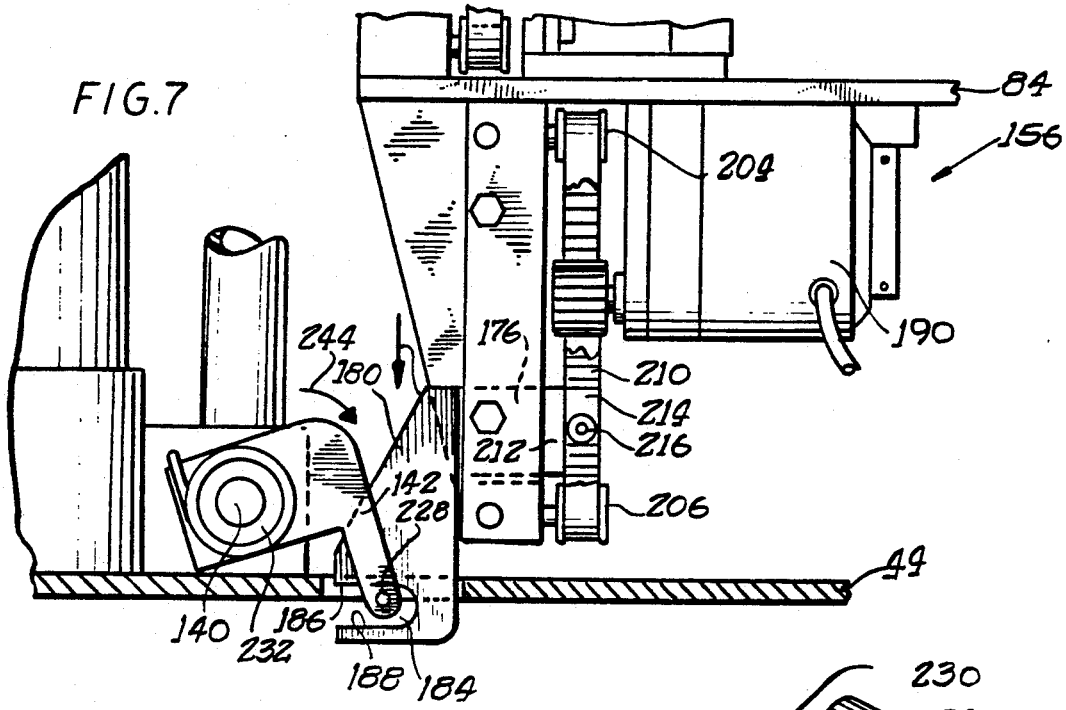
FIG. 7 is a fragmentary side elevational view, taken on an enlarged scale, showing the lower portion of FIG. 5 in greater detail including the sealing means constructed according to principles of the present invention.

Referring now to FIG. 7, the valve actuating mechanism 156 is illustrated on an enlarged scale, and the portions of drive belt 200 between the drive gear 194 and the idler rollers 204, 206 has been removed to show a bracket 212 rearwardly extending from travelling head 176. The vertical segment 210 of drive belt 200 is clamped between bracket 212 and a clamping piece 214, which are secured together by a threaded fastener 216. In the preferred embodiment, valve actuating motor 156 is a stepping motor, which is rotatable in opposing directions so as to be able to move the segment 210 of drive belt 200 in upward and downward vertical directions. Accordingly, the bracket 212, the travelling head 176 and the slotted bracket 180 attached thereto can be displaced in precise amounts in vertically upward and downward directions. FIG. 5 shows the crank arm 142 in a raised position, which closes the flow control valve in valve housing 132. When opening of the valve is desired, motor 190 is energized so as to move the belt portion 210 in a downward direction, thereby lowering the slotted bracket 180, and thus the crank arm 142, to the position indicated in FIG. 7, whereby the flow control valve within valve housing 132 is moved to an open position for dispensing of colorant material. This same motion also operates a sealing valve at the free ends of paint discharge nozzles carried by each colorant container assembly. A timed operation between the flow control and sealing valves is readily obtained.

Figure 8:
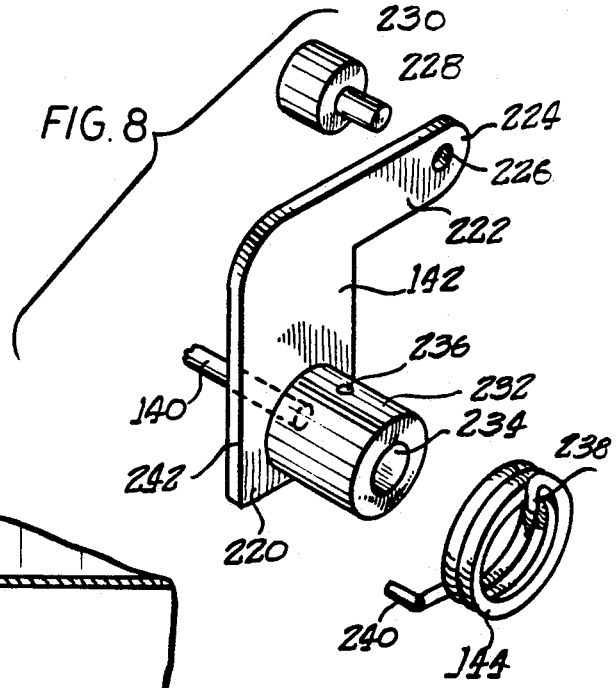
FIG. 8 is an exploded perspective view of the valve assembly portion of FIG. 7.

Referring now to FIG. 8, the crank arm 142 can be seen to have a generally L-shaped configuration with a first leg 220 overlying the axis of valve shaft 140, and a second leg 222 which, when the valve is in a closed position, extends in a horizontal direction, radially disposed with respect to the turntable. The second leg 222 has a rounded free end 224 in which an aperture 226 is formed to receive the shaft 228 of a roller 230. A collar 232 extends from the crank arm 142 and has an inner bore 234 for receiving the valve shaft 140. An aperture 236 is formed in the collar to receive a hook-shaped free end 238 of spring 144, so that, when installed, the spring 144 surrounds the collar 232 and is generally concentric therewith. The second end 240 of spring 144 engages an edge 242 of crank arm leg 220. The collar 232 is moveable with respect to crank arm 142, and the leg 220 of the crank arm has a keyed aperture for receiving the valve shaft 140 for keyed engagement therewith.

Thus, as the crank arm 142 is rotated in the clockwise direction of arrow 244 of FIG. 7, the coils of spring 144 are tightened, storing a bias force for returning the crank arm to the closed valve position illustrated in FIG. 5. With reference to FIG. 2, a series of generally rectangular openings 320 are formed in turntable 44, with one opening adjacent each container assembly. The openings 320 allow clearance for the crank arm legs 222 as the slotted bracket 180 is lowered to rotate the flow control valve shaft 140 in the clockwise direction of arrow 244.

Figure 9:
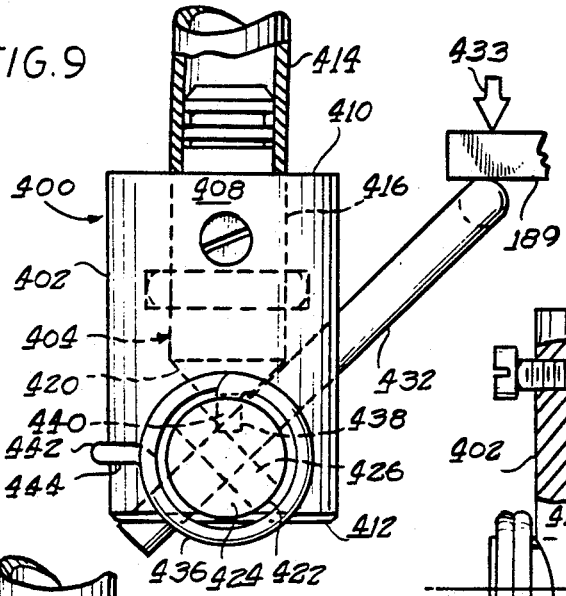
FIG. 9 is an enlarged perspective view of a sealing valve according to the present invention, shown in its closed position, attached to a nozzle.
Figure 10:
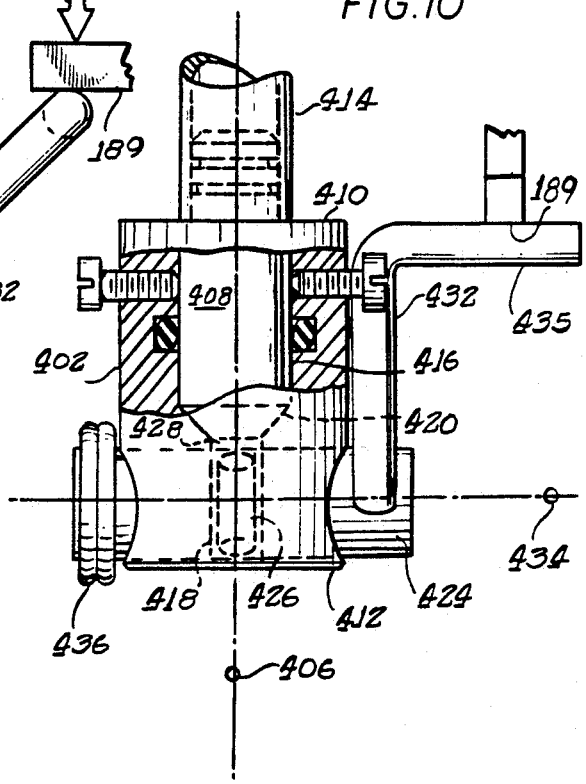
FIG. 10 is a partially broken away perspective view of the sealing valve shown in FIG. 9, rotated 90° from the position shown in FIG. 9.
Figure 11:
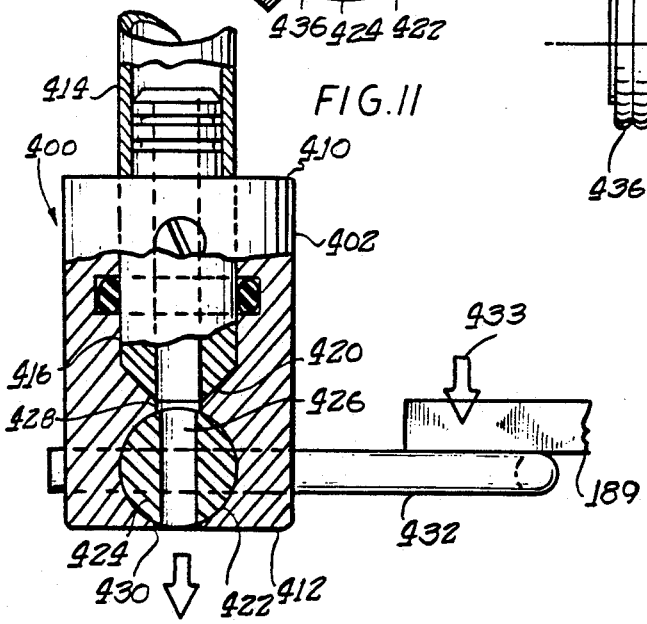
FIG. 11 is a partially broken away, enlarged perspective view of the sealing valve of FIG. 9 with the valve shown in its open position, rotated 180° from the position shown in FIG. 9.

Referring to FIGS. 9 through 11, a sealing valve according to the present invention is illustrated at 400. A cylindrical sealing valve body 402 has an axial bore 404 through its center along its central axis 406. This axial bore 404 defines a central passageway 408 through which paint colorant passes. The sealing valve body 402 has a nozzle receiving end 410 and a chamfered free end 412. The upper portion 416 of axial bore 404 is dimensioned for a close fit engagement with the downwardly projecting nozzle 414. The bore portion 416, located at the nozzle receiving end 410 of the valve body 402 is generally cylindrical, and has an enlarged size compared to the reduced diameter free end 412 of the valve body, herein referred to as the lower portion 418 of the axial bore 404. A transition section 420 joins the upper and lower portions 416 and 418, respectively, providing a continuous, uninterrupted flow-confining surface.

A transverse flow passageway 422 runs through, and perpendicular to, the lower portion 418 of the axial bore 404. A cylindrical rod 424 runs through the transverse bore 422 and is rotatable between open and closed positions, as will be discussed below. The cylindrical rod 424 has a flow passageway 426 therethrough which is perpendicular to the axis of the rod 424. The diameter of the flow passageway 426 through the rod 424 is preferably slightly smaller than the diameter of the lower portion 418 of the axial bore 404. In the preferred embodiment, there is a small space 428 between the rod 424 and the transition section 420. According to an important aspect of the present invention, there is only a small space 430 (See FIG. 11) between the rod 424 and the free end 412 of the sealing valve body 402, enough only to ensure the structural integrity of the valve body lower end. By way of example and not of limitation, one practical embodiment of the present invention had a valve body 31 mm. in length, and a reduced lower bore diameter of 4.5 mm. As an important feature, the distance between the transverse bore 422 and the valve body free end 412 was only on the order of 0.2 mm. The flow passageway 426 through the rod 424 is located along the length of the rod 424 so as to be coaxially aligned with axial bore 404 when the sealing valve is in the fully open position illustrated in FIG. 11. When the sealing valve 400 is in the closed position, the axial bore 404 of the valve body 402 is blocked by rod 424 so as to hermetically seal the valve body at the lower, free end thereof. Thus, any colorant residue remaining in the axial bore 404 of the valve body will not be allowed to harden or stiffen from one colorant dispensing operation to the next. Further, the axial bore, especially at the free end of the sealing valve body, is preferably polished and the transition section 420, as mentioned, provides a smooth blending of the axial bore portions to reduce buildup of colorant adhering to the bore walls. If desired, the axial bore can be coated with TEFLON or other suitable material to further reduce buildup.

An actuating arm 432 is attached to one end of the cylindrical rod 424. Preferably, the arm 432 runs perpendicular to the central axis 434 of the rod 424 at its point of attachment therewith. Swinging displacement of the actuating arm 432 rotates the rod 424 between its open position, in which the flow passageway 426 through the rod 424 is aligned with the axial bore 404 through the valve body 402 (See FIG. 11), and its closed position, in which the bore 426 through the rod 424 is brought out of communication with the axial bore 404 (See FIG. 9).

The valve opens upon rotation in the direction of arrows 433, and closes upon opposite rotation indicated by arrows 433. In the preferred embodiment, the flow passageway 426 through the rod 424 and the actuating arm 432 attached to the rod 424 are oriented relative to one another such that the sealing valve 400 is in its open position when the actuating arm 432 is perpendicular to central axis 406 of the sealing valve body 402, and the sealing valve 400 is in its closed position when the arm 432 is at an acute angle with respect to the central axis 406 of the sealing valve body 402. With brief reference to FIG. 10, it can be seen that these features are provided in an actuating arm 432 which is L-shaped, having a crank arm 435 integral with the actuating arm 432 and oriented approximately perpendicular thereto.

Referring to FIG. 9, the rod 424 is biased toward its valve-closed position by a coil spring 436 which is located on the opposite end of the rod from the actuating arm 432. An aperture 438 is formed in the rod 424 to receive a first hook-shaped free end 440 of sealing valve spring 436, so that, when installed, the coil spring 436 surrounds the rod 424 and is generally concentric therewith. A second hook-shaped free end 442 of the coil spring 436 is received in an aperture 444 formed in the valve body 402.

An annular recess 444, concentric with, and in communication with, the upper portion 416 of the axial bore 404, is provided in the sealing valve body 402. The recess 444 provides seating for a sealing member such as an O-ring 446 which aids in maintaining a hermetic seal between the nozzle 414 and the sealing valve body 402. The sealing is automatically accomplished when the nozzle is inserted in the upper portion 416 of the axial bore 404. The O-ring 446 also aids in securing the valve body 402 to the nozzle 414, as will now be described.

Referring to FIG. 10, threaded, radially extending holes are formed in the valve body 402. Screws 450 are threadedly engaged therewith, and with tightening of the screws 450, sealing valve body 402 is secured to the nozzle 414. In the preferred embodiment, two diametrically opposed screws 450 are employed, and they are located between the nozzle receiving end 410 of the sealing valve body 402 and the O-ring 446.

It should be noted from the above that, when the valve is in a closed position, the crank arm leg 222, which protrudes toward the valve actuator mechanism 156 is aligned to pass through the outwardly opening recess 184 of slotted bracket 180. When a container assembly and its associated crank arm are located at the dispensing station 150, the crank arm leg 222 is received in the slotted recess 184 of the angle bracket.

According to another feature of the present invention, the protruding legs 222 of the crank arms associated with the flow control valves of the several colorant container assemblies 50 are aligned to pass through the same recess 184 of angle bracket 180. Also, the crank arm 435 of the sealing valve 400 passes under the bottom surface 189 of slotted bracket 180. Thus, both the crank arms 435 of the sealing valve 400 and the legs 222 of the flow control valve 130 freely pass by the angle bracket 180, thus avoiding any contact or other interference between the rotating and stationary portions of the colorant and dispensing apparatus 10. Although the angle bracket 180 could be mounted for pivoting movement or perhaps radially inward translational movement away from the path of travel of the protruding crank arms 222, such is generally not preferred, as the complexity and cost of the mechanism is thereby increased and the chances of losing precision in operation of the angle bracket are increased.

Although, as has been seen above, the angle bracket 180 is moveable in vertical directions, it is preferred that the angle bracket be fixed with respect to movement in other directions, thus simplifying the design of the angle bracket and the associated mechanism for actuating that bracket, while reducing the risk of inaccuracies when repetitively operating the crank arms of the several colorant containers. As mentioned above, the valve construction and operation follow the principles disclosed in U.S. Pat. No. 4,027,785. Accordingly, due to the multiple porting of the valve shaft and the close tolerance angular displacement of that porting, the valve actuating mechanism must be capable of fairly accurate rotational displacement of the valve shaft to insure proper operation of the dispensing valve. Also, it is desirable to operate the sealing valve with the same actuating bracket. The various features of the valve actuating mechanism 156 achieve these benefits.

As will be seen below, these same principles of limited movement of the pump actuating mechanism along a highly accurate repeatable path of actuation, coupled with an ability to clear the interengaging projections of rotating container assemblies are also found in the metering apparatus. These objectives are achieved in a colorant dispensing and metering apparatus which is compact and which can be simply and economically formed from a minimum number of relatively inexpensive parts.

Referring again to FIGS. 2, 5 and 6, a mechanism for actuating the metering pumps of the various colorant containers is generally indicated at 250. As will be seen, the pump actuator mechanism 250 has certain similarities to the valve actuating mechanism 156 described above. For example, header and footer blocks 252, 254 are secured to sidewalls 256, 258 by suitable means, such as threaded fasteners 260. Generally cylindrical guide rails 262 are secured at their opposed ends to the header and footer blocks 252, 254. A travelling head 264 is mounted on guide rails 262 for reciprocation in vertical directions, indicated by the double headed arrow 266.

A pump drive motor 268 is attached to upper plate 84 and is oriented to have a generally horizontal, forwardly extending output shaft. A drive gear 270 is secured to the motor output shaft for rotation therewith, and has teeth on its outer surface for meshing with a cog belt 272. With reference to FIG. 6, the cog belt 272 has a generally triangular or three-sided configuration, being supported at one corner by the aforementioned drive gear 270, and being supported at the remaining corners by upper and lower idler rollers 274, 276. The upper and lower drive rollers 274, 276 are disposed one above the other so that the section 280 of cog belt 272 suspended therebetween extends in a generally vertical direction. Drive motor 268 is preferably of the step motor type, being capable of controlled operation in opposing directions of rotation. Thus, in operation, the drive motor 268 can be stepped in response to electrical control signals to move the vertical section 280 of cog belt 272 in defined vertical increments.

Referring again to FIG. 5, a bracket 280 extends rearwardly from travelling head 264 and is positioned to contact a surface of cog belt section 280. A clamping member 282 is placed over an opposing surface of cog belt 272 and is secured to bracket 280 with a suitable fastener 284. Thus, the travelling head 264 is clamped to the cog belt section 280 for travel therewith in reciprocating vertical directions. Referring to FIGS. 5 and 6, the travelling head 264 is illustrated in its uppermost position. With reference to FIG. 6, rotation of the output shaft of motor 268 in the counterclockwise direction of arrow 282 will cause the cog belt section 280, and the travelling head 264 secured thereto, to travel in a downward direction, to a lowered position, such as that illustrated in phantom in FIG. 6.

An upstanding bracket 290 is secured to the forward portion of travelling head 264 by suitable means such as threaded fasteners 291. Upper and lower rollers 292, 294 are secured to the upper portion 296 of bracket 290. The rollers 292, 294 preferably have mounting shafts similar to the mounting shaft 228 of roller 230, described above with reference to FIG. 8. The rollers 292, 294 are mounted for rotation about generally horizontal, radially extending axes. In the preferred embodiment, the axes of rotation of the rollers 292, 294 are disposed one above the other. As indicated in FIG. 5, the rollers 292, 294 are preferably spaced apart a small distance so as to form an opening 300.

The metering pump 134 includes a shaft 136 mounted to a piston disposed within a cylindrical pump housing 138. The lower end of pump housing 138 is joined to valve housing 132 and the valve 130 is operable to block the discharge from the pump, and to also control its intake of liquid colorant material from the container 52.

Referring again to FIG. 5, the pump 134 has a piston-connected shaft or rod 136 which is moveable in vertical directions indicated by the double-headed arrow 302. The upper, free end 304 of rod 136 receives a washer 306 which is secured thereto by threaded fasteners 308. In the preferred embodiment, the washer 306 is oriented generally perpendicular to the vertical axis of rod 136 so as to present a minimum profile to the opening 300 between rollers 292, 294. As turntable 44 is rotated in the opposing directions indicated by double-headed arrow 152, the washers 306 associated with the colorant container assemblies 50 are moved past the dispensing station 150, being passed through the opening 300 formed between rollers 292, 294.

In the preferred operation of the colorant and dispensing apparatus 10, the travelling head 264 of the pump actuating mechanism 250 is int he lowered position indicated in FIG. 2 and the pump rods 136 of the colorant container assembly 50 are in the indicated lower or retracted position aligned with the opening 300 between rollers 292, 294. As will now be appreciated, as the washers 306 of various colorant container assemblies are passed between rollers 292, 294, the washer and rollers present curved, generally circular surfaces to one another which reduce the risk of binding as the initial areas of nipping engagement are very small, and are gradually increased at a steady rate. As with the slotted bracket for the valve actuating mechanism, the space between rollers 292, 294 is pat of a continuous opening which lies in a horizontal plane passing through opening 300 thus allowing free, unobstructed passage of the protruding washers carried on the plurality of colorant container assemblies.

The operation of the pump actuating mechanism 250 has many of the same advantages as described above with reference to the valve actuating mechanism 156. For example, the pump actuating mechanism has a protrusion receiving recess 300 for the washers 306 which is fixed, being defined by a pair of fixedly spaced-apart guide surfaces, herein the outer surfaces of rollers 292, 294. Further, the guide rollers 292, 294 are constrained for movement in vertical directions. If desired, the bracket 290 carrying the rollers 292, 294 could be mounted for rotation or radially inward translation away from the path of passing washers 306, but such is generally not preferred.

Accordingly, it is required that the washers of colorant container assemblies passing through the dispensing station be received in an opening 300 between the rollers 292, 294, the locations of which are fixed in space. Additional advantages are provided by the rollers 292, 294 in that the rollers are mounted for rotation about their central axes, corresponding to the direction of forces imparted thereto by moving washers 306, should contact therebetween be experienced. Further, in the unlikely event that a washer 306 of a particular colorant container assembly should become slightly displaced during operation of apparatus 10, or during a servicing procedure, for example, the rollers 292, 294 with a minimum of disturbance, will guide the washer 306 to a very accurately defined height above turntable 44.

As can be seen from the above, the valve actuating mechanism 156 and the pump actuating mechanism 250 can be readily adapted for use with digital and other electronic control systems. One advantage of a colorant metering and dispensing apparatus constructed according to principles of the present invention, is that the actuating mechanisms can be economically constructed from a minimum number of inexpensive parts, thereby avoiding the higher costs of construction and maintenance commonly associated with automated mechanisms which must repeatedly operate with accurate, well defined movements.

In the preferred embodiment of a colorant metering and dispensing apparatus having a sealing valve according to the present invention, a programmable computer 18 is provided in lower housing 12 for the fully automatic operation of apparatus 10. However, if desired, the actuating mechanisms and related features of the colorant metering and dispensing apparatus can be fully automated under the control of electrical systems which are not necessarily of a programmable nature. For example, the programmable computer 18 can be replaced by one or more feedback control circuits, either of the closed loop or open loop type. However, the programmable computer is preferred for automated control of apparatus 10 since, as will be appreciated by those skilled in the art, changes in a family of paint colors often requires numerous adjustments to the various paint formulations associated with that color family. With the programmable computer, families of color formulations can easily be entered through keyboard 24, or through magnetic storage media which can be read into and stored in the electronic memory within computer 18. The CRT monitor 22 provides an easy means of locating a paint formulation stored in the computer for use on demand, as when it is desired to color a given quantity of paint base material to obtain a paint product of a specified color.

In a fully automated paint coloring operation, the turntable 44 is indexed to present a series of selected paint colorant container assemblies to dispensing station 150. Given a particular color family of paint colors, formulations for each color are stored in computer 18. The formulations for particular colors will specify the particular colorant and the amount of such colorant to be dispensed in the container of paint base material. This is accomplished by identifying a particular position on turntable 44 for the colorant container assembly holding the desired liquid colorant material.

The formulation for each selected colorant material will also specify the amount of such material to be dispensed at station 150. Thus, means are provided responsive to indexing signals outputted by computer 18, to rotate turntable 44 a necessary amount to present a particular colorant container assembly to workstation 50. Thereafter, the computer 18 outputs valve actuation signals and metering pump actuation signals which displace the slotted bracket 180 and the upstanding bracket 290 holding rollers 292, 294 prescribed amounts to accomplish the metered dispensing of a colorant from a particular colorant container assembly presented to workstation 150.

More particularly, the meter actuation signals cause the pump motor 268 to displace the travelling head 64 a carefully prescribed amount so as to raise washer 06, and hence the piston within pumping chamber 134, a carefully controlled distance so as to withdraw an accurate amount of liquid colorant material through valve housing 132 into the pumping chamber. Thereafter, the valve actuating motor 190 receives valve actuation control signals from computer 18 which cause the travelling head 176 to descend, thereby rotating valve shaft 140 in a desired sequence of steps which first introduces a port between the container 52 and pump housing 134 to permit the withdrawal of colorant material. Upon completion of the metered withdrawal, the valve actuating motor is further rotated to present another port which allows dispensing of the metered colorant temporarily stored in pump housing 134, as travelling head 264 is lowered to its rest position, thereby forcing the metered colorant from the discharge outlet of the metering or pump chamber. The colorant material then enters nozzle 414 before being discharged through nozzle outlet 452 to the underlying paint bucket. It is, of course, important that opening of the sealing valve 400 be coordinated with opening of flow control valve 130 and the subsequent discharge exiting nozzle 414. The relative positioning of crank arms 222 and 435 and the distance between upper slot surface 186 and the bottom surface 189 of bracket 180, as well as the lengths of the crank arms 222 and actuating arms 432 ensure the desired timed cooperation to ensure that sealing valve 400 does not block the discharge of colorant material or otherwise impair the metering accuracy.

As illustrated in FIGS. 5 and 7, the slot 184 in bracket 180 is considerably larger than roller 230. As the slotted bracket 180 is lowered, it applies pressure to the crank arm 142 and the engagement with the crank arm comprises a low friction rolling motion. When a dispensing operation has been completed and closure of valve 130 is desired, the direction of rotation of drive motor 190 is reversed so as to raise slotted bracket 180. Due to the spring bias return applied to shaft 140, engagement of roller 230 with the upper slot surface 186 is maintained. Thus, if desired, the lower slot surface 188 and the material of bracket 180 therebelow could be removed. However it is desirable to maintain the lower portion of bracket 180, that portion below slot surface 188, so as to insure a foolproof return of the valve shaft to its closed position. It should be noted in this regard, that with the valve in the fully opened position, as illustrated in FIG. 7, the crank arm leg 222 is inclined at an angle from the vertical so as to prevent any binding that would otherwise interfere with the valve closing.

As mentioned above, a fully automated paint metering and dispensing apparatus requires indexing means for indexing the turntable 44 so as to present one or more preselected colorant container assemblies to the dispensing station 150. As has been seen from the above, the indexing means includes a rotatably driven support shaft 108. The rotating drive for shaft 108 may take any one of a number of conventional forms, and will not be described further. It is important that the rotatable drive be able to determine when a particular colorant container assembly is precisely located at the dispensing station 150. The indexing means should also be capable of tracking the locations of the various colorant container assemblies.

A pair of sensors, preferably optical sensors are provided for collecting data from which the location of the colorant container assemblies can be adduced. The optical sensors are illustrated in FIGS. 2, 3 and 5, and are indicated by reference numerals 322, 324. The sensors are mounted in a V-shaped bracket 326 which is supported at the end of an extension member 328 mounted to receive cantilever support from backwall 86. A support block 330 provides additional support. The sensors 322, 324 may comprise a transmitter/receiver pair, or each sensor may include both transmitting and receiving elements. Electrical leads 334 from the sensors are fed through the inner bore 126 of stationary support post 116, and are coupled at their remote ends to computer 18. The signals from sensors 322, 324 are fed into computer 18 along conductors 334 to provide a feedback signal to the turntable rotation drive which is also controlled by computer 18. Any of a number of conventional control circuit designs can be used to index turntable 44 so as to accurately position a particular colorant container assembly at dispensing station 150.

Operation of the colorant metering and dispensing apparatus is initiated with the entry of a desired paint color and quantity size which is entered into computer 18 via terminal 24. The computer matches the paint name to a formulation stored either in its memory, or on a floppy disk or the like magnetic storage media. The paint formulation specifies the colorants used in the particular formula, and the amount of colorant required, depending upon the container size indicated. According to one aspect of the present invention, the computer looks up the present location of the turntable, which has been previously indicated by the sensors 322, 324. The computer then calculates the closest container assembly called for in the formula, and the direction of rotation required to bring that colorant assembly to the dispensing station in the shortest possible time.

As the container assembly approaches the dispensing station, the roller 230 associated with the container assembly valve, and the washer 306 also associated with the particular assembly engage the slotted bracket 180 and the washer associated with the assembly enters the nip between idler rollers 292, 294. Next, the computer sends a valve actuation signal to the stepper motor 190 which rotates a preselected amount necessary to rotate the flow control valve shaft 140 to a first incremental position whereby an internal passageway is cleared for withdrawal of the colorant material by pump 134. Thereafter, the computer sends a meter actuation signal to stepper motor 268 which raises the washer 306, and hence the pump rod 136 connected thereto, a predetermined height by which a quantity of colorant extracted from container 52 is metered to within close tolerance limits according to the programmed paint formulation. When the upstroke of the pump rod 136 is completed, the stepper motor 190 is again activated to further rotate flow control valve shaft 140, thereby isolating the pump 134 from container 52, and opening a passageway through which the contents of the pump can be discharged through the outlet 452 of a downwardly projecting nozzle 414 into a paint bucket or the like receptacle disposed on platform 30.

Meter actuating signals to stepper motor 190 are timed with respect to signals to stepper motor 268, so as to coordinate vertical translation of the pump rods 136 and bracket 180, with both the flow control valve 130 and sealing valve 400 opening at the proper time so as to allow free flow of colorant from the nozzle outlet 452. Downward movement of bracket 180 engages rollers 230 attached to the legs 222 of the flow control valve crank arm 142, thereby rotating the flow control valve shaft 140 toward its fully open discharge position. At a predetermined position in its downward translation, the bottom surface 189 of slotted bracket 180 engages the crank arm portion 435 of the sealing valve actuating arm 432. The flow control valve crank arms 142 and legs 222, the sealing valve actuating arms 432 and crank arms 435, as well as the slotted bracket surfaces 186 and 189 are dimensioned such that both the flow control valve 130 and sealing valve 400 are both in their fully open positions at the downward most point of travel of the slotted bracket.

Referring to FIG. 7, according to one aspect of the present invention, the desired coordination between the flow control valve and the sealing valve is preferably provided by configuring bracket 180 so as to achieve a controlled, fixed distance between the upper recess edge 186 and the lower bracket edge 189. The lower bracket edge can be adjusted by changing the thickness of the lower bracket leg underneath recess 184, or shim plates can be secured to the bottom edge 189 to increase the leg thickness. Alternatively, a shoe can be slipped over the free end of the bracket lower leg. According to an important aspect of the present invention, both flow control and sealing valves can be operated by a ingle actuator system, and in particular, by the same bracket 180, thus avoiding the need for any additional drive motors, travelling carriages or the like equipment.

Further meter actuating signals are then sent to stepper motor 268 to lower the washer 306 to the rest position illustrated in FIG. 2, for example. Upon discharge of the metered colorant in pump 134, additional valve actuation signals are sent to stepper motor 190 so as to raise the slotted bracket 180, thereby allowing flow control valve shaft 140 and sealing valve rod 424 to rotate in counterclockwise directions under the force of coil springs 144 and 436. Alternatively, the slotted bracket 180 can be raised to engage the idler roller 230 so as to force the crank arm associated with the valve to a fully closed position, such as that illustrated in FIG. 5. The computer keeps track of the colorants which have been dispensed, and reviews the paint formulation to see if additional colorants are needed. If they are, the turntable is scanned for the location of the closest container assembly holding colorant which is required by the formulation. The indexing, metering and dispensing steps are repeated as many times as are required until all colorants required by the formulation have been dispensed.

According to one aspect of the present invention, the paint formulations are stored on a magnetic storage media and the computer 18 is programmed for fully automatic reading of the stored information, without requiring intervention by an operator of the paint colorant and dispensing apparatus. In this manner, paint formulations for entire families of paint colors and for different paint product lines can be quickly and easily disseminated to a large number of users.

The drawings and the forgoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Apparatus for dispensing a metered quantity of colorant from the storage canister into a container comprising:

a) a metering chamber having an inlet and an outlet and means for withdrawing a determined quantity of colorant from said storage canister through said metering chamber inlet, and pump means for discharging the colorant in said metering chamber through said metering chamber outlet;

b) flow control valve means at the outlet of said metering chamber for controlling the discharge of colorant material therefrom;

c) a nozzle having a free end, downwardly extending from the outlet of said metering chamber so as to direct the flow of discharged colorant;

d) a sealing valve means located at the free end of said nozzle movable between a first, open position and a second, closed position so as to permit a flow of discharged colorant and to seal the free end of the nozzle to prevent intrusion of air therein, respectively, including:

1) a body having an internal wall defining an internal passageway through which paint colorant is passed, having an upper portion for receiving the nozzle free end with a close fit engagement thereof, and a lower portion remote from the free end;

2) a sealing member in the upper portion for hermetic sealing of the body to the nozzle free end;

3) a cylinder disposed in the lower internal passageway portion, defining an aperture through which paint colorant is dispensed, movable between open and closed positions to open and close a path of colorant flow through said body, respectively;

4) means for securing said body to said metering means so as to maintain said hermetic sealing between said body and the nozzle free end; and 5) an actuating arm joined to said cylinder for moving said cylinder between said open and said closed positions.

2. Apparatus as claimed in claim 1 wherein said internal passageway has a circular cross-section.

3. Apparatus as claimed in claim 2 wherein said upper portion of said internal passageway has a greater diameter than said lower portion.

4. Apparatus as claimed in claim 1 wherein said sealing member comprises an O-ring within said valve body engaging said nozzle inserted in said passageway.

5. Apparatus as claimed in claim 4 wherein said means for securing said body to said metering means comprises a threaded fastener engageable with said nozzle.

6. Apparatus as claimed in claim 5 wherein said threaded fastener is located upstream of said O-ring.

7. Apparatus as claimed in claim 1 further comprising means for biasing said cylinder to said closed position and wherein said actuating arm is double-ended and L-shaped, with one end secured to said cylinder and the other end having an edge surface engageable by an actuator for moving said cylinder between said open and closed positions.

8. Apparatus as claimed in claim 7 wherein said flow control valve has an actuating arm for moving the flow control valve between said open and closed positions, said flow control and sealing valve actuating arms having free ends adjacent one another so as to lie in the path of travel of said actuator for the common actuation of both valves.

9. Apparatus as claimed in claim 1 wherein the cross-sectional area of said aperture is smaller than said internal passageway upper and lower portions.

10. Apparatus as claimed in claim 9 wherein said cylinder is spaced 0.2 mm. from the free end surface of said body.

11. Apparatus as claimed in claim 1 wherein the longitudinal axis of said cylinder is generally perpendicular to the longitudinal axis of said internal passageway.

12. Apparatus as claimed in claim 11 wherein the body defining the lower portion has a free end surface and said cylinder is spaced no more than 0.5 mm. from the free end surface of said body.

13. A machine for coloring a container of paint base material, comprising:

a plurality of storage canisters for holding paint colorant materials;

said canisters including metering means associated with each storage canister for withdrawing a preselected amount of colorant material from the storage canister;

said storage canisters further including flow control valve means with an actuating arm associated with each metering means for controlling a discharge of colorant material from said metering means through a discharge opening of a nozzle;

a turntable on which said canisters are mounted for rotation about said circular path of travel;

operating means disposed adjacent said path for delivering metered amounts of colorant material to said container of paint base material;

said operating means including meter actuating means for actuating said metering means to withdraw a preselected quantity of colorant material from the associated canister and to discharge said colorant material into the container of paint base material;

said operating means including flow control valve actuating means for opening and closing the flow control valve means to permit selective discharge of said colorant to said container of paint base material;

said operating means including sealing valve means associated with each metering means, located downstream of said flow control valve means and movable between open and closed positions for permitting colorant flow and for sealing the discharge opening of the nozzle, respectively;

means for coordinating the opening of the flow control and sealing valve means, operable by said flow control valve actuating means; and indexing means for indexing said turntable in response to an indexing signal so as to present a preselected container to said operating means.

14. A machine for coloring a container of paint base material as in claim 13 wherein said sealing valve means comprises:

a body having an internal wall defining an internal passageway through which paint colorant is passed, having an upper portion for receiving the nozzle free end with a close fit engagement thereof, and a lower portion remote from the free end;

a sealing member in the upper portion for hermetic sealing of the body to the nozzle free end;

a cylinder disposed in the lower internal passageway portion, defining an aperture through which paint colorant is dispensed, movable between open and closed positions to open and close a path of colorant flow through said body, respectively;

means for securing said body to said machine so as to maintain said hermetic sealing between said body and the nozzle free end; and an actuating arm joined to said cylinder for moving said cylinder between said open and said closed positions when engaged by said means for coordinating.

15. A machine for coloring a container of paint base material as in claim 14 wherein said means for securing said body to said machine comprises a threaded fastener engageable with said nozzle.

16. A machine for coloring a container of paint base material as in claim 15 wherein said means for securing said body to said machine is located upstream of said O-ring.

17. A machine for coloring a container of paint base material as in claim 14 wherein said internal passageway has a circular cross-section.

18. A machine for coloring a container of paint base material as in claim 14 wherein said internal passageway upper portion has a greater diameter than in said lower portion.

19. A machine for coloring a container of paint base material as in claim 14 wherein said sealing member is a close fit engagement of said nozzle with said internal wall of said valve body.

20. A machine for coloring a container of paint base material as in claim 14 wherein said sealing member comprises an O-ring within said valve body engaging said nozzle inserted in said passageway.

21. A machine for coloring a container of paint base material as in claim 14 further comprising means for biasing said cylinder to said closed position and wherein said cylinder actuating arm is double-ended and L-shaped, with one end secured to said cylinder and the other end having an edge surface engageable by said means for coordinating for moving said cylinder between said open and closed positions.

22. A machine for coloring a container of paint base material as in claim 21 wherein said flow control valve actuating means comprises a reciprocating member for operating said means for coordinating which in turn engages both said flow control valve and said sealing valve actuating arms.

23. A machine for coloring a container of paint base material as claimed in claim 22 wherein the open position of said sealing valve means corresponds to an end stroke of said reciprocating member.

24. A machine for coloring a container of paint base material as claimed in claim 22 wherein said means for coordinating when operated by said reciprocating member opens said flow control valve means and said nozzle sealing valve means substantially simultaneously.

25. A machine for coloring a container of paint base material as claimed in claim 21 wherein said means for coordinating comprises a bracket having internal edge surfaces defining an opening for receiving the flow control valve actuating arm and a lower edge surface for engaging the sealing valve actuating arm, said internal and lower edge surfaces engaging said flow control and sealing valve actuating arms at the same time so that with downward movement of said bracket, both said flow control valve means and said sealing valve means are moved to their respective open positions at approximately the same time.

26. A machine for coloring a container of paint base material as claimed in claim 14 wherein the longitudinal axis of said cylinder is generally perpendicular to the longitudinal axis of said internal passageway.

27. A machine for coloring a container of paint base material as claimed in claim 14 wherein the body defining the internal passageway lower portion has a free end surface and said cylinder is spaced no more than 0.5 mm. from the free end surface.

28. A machine for coloring a container of paint base material as claimed in claim 14 wherein said cylinder is spaced 0.2 mm. from the free end surface.

29. A machine for coloring a container of paint base material as claimed in claim 14 wherein the cross sectional area of said aperture is smaller than that of said lower portion of said internal passageway.

* * * * *

UNITED STATES PATENT AND TRADEMARK OFFICE

CERTIFICATE OF CORRECTION

PATENT NO. : 5,078,302

DATED : January 7, 1992

INVENTOR(S) : Leen Hellenberg

It is certified that error appears in the above-identified patent and that said Letters Patent is hereby corrected as shown below:

In Column 4, line 27, change "for ed" to read the word --formed--.

In Column 4, line 35, after the word "FIGS" insert a period --.--.

In Column 4, line 46, after the word "mentioned" delete the comma ",".

In Column 12, line 44, change "int he" to read --in the--.

In Column 12, line 56, change "pat" to read --part--.

In Column 14, line 9, change the numeral "50" to read --150--.

In Column 14, line 17, change "64" to read the numeral --264--.

In Column 14, line 18, change "06" to read the numeral --306--.

In Column 16, line 41, change "ingle" to read the word --single--.

In Column 16, line 45, change "actuating" to read --actuation--.

In Column 17, line 7, change "forgoing" to read --foregoing--.

UNITED STATES PATENT AND TRADEMARK OFFICE

CERTIFICATE OF CORRECTION

PATENT NO. : 5,078,302

DATED : January 7, 1992

INVENTOR(S) :
Leen Hellenberg

It is certified that error appears in the above-identified patent and that said Letters Patent is hereby corrected as shown below:

In Column 17, line 19 (Claim 1, line 2), change "the" to read --a--.

In Column 20, line 21 (Claim 24, line 5), delete the word "nozzle".

Signed and Sealed this

Twenty-fifth Day of May, 1993

*Attest:*

Michael K. Kirk

MICHAEL K. KIRK

*Attesting Officer*

*Acting Commissioner of Patents and Trademarks*